United States Patent [19]

Tsubuko et al.

[11] 4,250,241

[45] Feb. 10, 1981

[54] LIQUID DEVELOPER FOR USE IN ELECTROPHOTOGRAPHY

[75] Inventors: Kazuo Tsubuko, Numazu; Taro Kimura, Tokyo; Motoo Tasaka; Junichiro Hashimoto, both of Numazu, all of Japan

[73] Assignee: Ricoh Company, Ltd., Tokyo, Japan

[21] Appl. No.: 71,447

[22] Filed: Aug. 31, 1979

[30] Foreign Application Priority Data

Sep. 6, 1978 [JP] Japan ..... 53-109261

[51] Int. Cl.[3] ..... G03G 9/12

[52] U.S. Cl. ..... 430/114; 430/112; 430/115; 430/116; 430/137

[58] Field of Search ..... 430/112, 113, 114, 115, 430/116, 117, 137

[56] References Cited

U.S. PATENT DOCUMENTS

| | | | |
|---|---|---|---|
| 3,997,488 | 12/1976 | Tsubuko et al. | 430/112 |
| 4,060,493 | 11/1977 | Tsubuko et al. | 430/113 |
| 4,081,391 | 3/1978 | Tsubuko et al. | 430/114 |
| 4,104,183 | 8/1978 | Tsubuko et al. | 430/114 |
| 4,181,620 | 1/1980 | Tsubuko et al. | 430/114 |

*Primary Examiner*—Mary F. Downey
*Attorney, Agent, or Firm*—Blanchard, Flynn, Thiel, Boutell & Tanis

[57] ABSTRACT

A liquid developer for use in electrophotography which is prepared by making a carrier liquid comprising a non-aqueous solvent having a highly insulating property and a low dielectric constant contain a coloring agent and a resin dispersed therein, characterized in that said resin contains the following components (A) and (B):

(A) a polymer comprising at least one kind of resin having an acetone tolerance value of 100–5000 and at least one kind of monomer capable of dissolving said resin, and (B) a non-aqueous type thermoplastic resin obtained by esterifying a copolymer obtained from a monomer having the general formula I

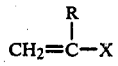

[wherein R is —H or —$CH_3$ and X is —$COOC_nH_{2n+1}$ or —$OC_nH_{2n+1}$ ($6 \leqq n \leqq 20$)], and any one of a monomer having a glycidyl group, an unsaturated carboxylic acid and its anhydride, with said unsaturated carboxylic acid or its anhydride when said copolymer has the glycidyl group as the constitution unit and with the monomer having the glycidyl group when the copolymer has the unsaturated carboxylic acid or its anhydride as the constitution unit; and further graft-polymerizing the unsaturated portion of the resulting esterification product with at least one member of monomers having the general formula II

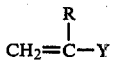

[wherein R is —H or —$CH_3$ and Y is —$COOC_{n'}H_{2n'+1}$ ($1 \leqq n' \leqq 4$), —$OCOC_mH_{2m+1}$ ($1 \leqq m \leqq 6$),

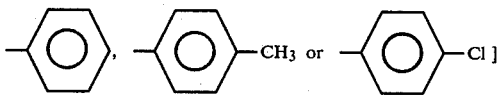

and the general formula III

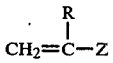

[wherein R is —H or —$CH_3$, and Z is —$COOCH_2$-CH—N $(C_{n''}H_{2n''+1})_2$ ($1 \leqq n'' \leqq 5$), —COOH, —$COOC_2H_4OH$ or

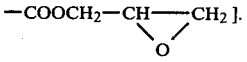

12 Claims, No Drawings

LIQUID DEVELOPER FOR USE IN ELECTROPHOTOGRAPHY

BACKGROUND OF THE INVENTION (a) Field of the Invention

The present invention relates to a liquid developer for use in electrophotography, in particular a liquid developer for use in electrophotography which is prepared by dispersing a toner consisting essentially of a pigment of dye and a specific nonaqueous resin dispersion uniformly in a carrier liquid having a highly insulating property and a low dielectric constant.

(b) Description of the Prior Art

Conventional liquid developers for use in electrophotography (which may be called liquid developers or developers for short hereinafter) are prepared by dispersing, in a carrier liquid having a high insulating property and a low dielectric constant such as a petroleum type aliphatic hydrocarbon, a toner consisting essentially of carbon black, organic pigment or organic dye and synthetic or natural resins such as acrylic resin, phenolmodified alkyd resin, staybelite resin, rosin, synthetic rubber, etc., and further consisting of a polarity controlling agent such as lecithin, metallic soap, linseed oil, high fatty acid or the like.

In these developers, the resin contained in the toner adheres to the coloring agent (pigment or dye) and the polarity of the toner is maintained distinctly positive or negative and the toner itself exhibits a uniform dispersion stability.

In the developing step, the toner as aforesaid gives rise to electrophoresis depending upon the degree of charge of an electrostatic latent image formed on the surface layer of the electrophotographic photosensitive material (or electrostatic recording material) so as to be fixed on the surface, whereby a copied image is formed. However, the developers were defective in that because the resin and/or the polarity controlling agent constituting the toner diffuse and dissolve in the carrier liquid with the passing of time, the polarity becomes indistinct. When using such developers, accordingly, there are brought about deterioration of image density and fixability, increase in background contamination and so forth, resulting in the copied image being poor in sharpness. In addition, because the printing durability is low and the change of developers with the passing of time is large there can not be obtained images having a high concentration.

Still further, such conventional developers, once the toner agglomerates, were difficult to be re-used, because it was impossible to re-disperse the agglomerated toner in the carrier liquid. Due to these deficiencies inherent thereto, such conventional liquid developers were not suitably used for offset printing or transfer such as charge transfer, press transfer, magnetic transfer and the like.

SUMMARY OF THE INVENTION

It is a primary object of the present invention to provide a liquid developer for use in electrophotography which substantially alleviates the foregoing defects, increases the image density, improves the printing durability when used in a copying machine, and is exceedingly superior in the properties such as dispersion stability, fixability and re-dispersibility. And it is another object of the present invention is to provide a liquid developer for use in electrophotography which is suitably used also for offset printing and various kinds of transferring, not to mention that it is suitably used for electrophotography (or electrostatography).

That is, in accordance with the present invention there is provided a liquid developer for use in electrophotography which is prepared by making a carrier liquid comprising a non-aqueous solvent having a high insulating property and a low dielectric constant contain, dispersed therein, a coloring agent and a resin, characterized in that said resin includes a resin A (component A) obtained by the polymerization reaction of at least one kind of resin having an acetone tolerance value of 100–5000 with at least one kind of monomer capable of dissolving said resin and a non-aqueous type thermoplastic resin B (component B) obtained by esterifying a copolymer obtained from a monomer having the general formula (1)

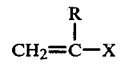

wherein R is —H or —$CH_3$ and X is —$COOC_nH_{2n+1}$ or —$OC_nH_{2n+1}$ ($6 \leqq n \leqq 20$), and any one of a monomer having a glycidyl group, an unsaturated carboxylic acid and its anhydride, wherein the copolymer is esterified with said unsaturated carboxylic acid or its anhydride when said copolymer has the glycidyl group as a structural unit thereof and wherein the copolymer is esterified with the monomer having the glycidyl group when the copolymer has the unsaturated carboxylic acid or its anhydride as a structural unit thereof; and further graft-polymerizing the unsaturated portion of the resulting esterification reaction product with at least one member of monomers having the general formula (2)

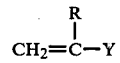

[wherein R is —H or —$CH_3$ and Y is —$COOC_{n'}H_{2n'+1}$($1 \leqq n' \leqq 4$), —O-$COC_mH_{2m+1}$($1 \leqq m \leqq 6$),

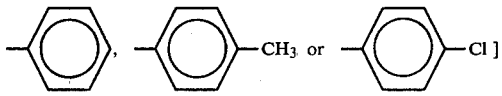

and the general formula (3)

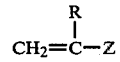

[wherein R is —H or —$CH_3$, and Z is —$COOCH_2$-CH—$N(C_{n''}H_{2n''+1})_2$($1 \leqq n'' \leqq 5$), —COOH, —$COOC_2H_4OH$ or

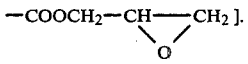

DETAILED DESCRIPTION OF THE INVENTION

Hereinafter, the present invention will be explained in more detail. As the nonaqueous solvent used in the present invention there can be enumerated those homegenous to the carrier liquid, in other words, having a highly insulating property (wherein the electric resistance is more than $10^9\Omega\cdot$cm) and also a low dielectric constant (wherein the dielectric constant is less than 3), for example, concretely petroleum type aliphatic hydrocarbons, for instance, n-hexane, ligroin, n-heptane, n-pentane, isododecane, isooctane, etc., and in addition thereto, their halogen derivatives, for instance, such as carbon tetrachloride, perchloroethylene, etc. The aforesaid petroleum type aliphatic hydrocarbons are commercially available as Isopar F, Isopar G, Isopar L, Isopar H, Isopar K, Nphtha No. 6, Solvesso 100, etc., manufactured by Exxon Company. These may be employed solely or using two or more in combination.

The coloring agent, i.e. pigment or dye, which may be used in the toner of the present invention can include hitherto well known ones, for instance, such as Alkali Blue, Phthalocyanine Green, Oil Blue, Spirit Black, carbon black, Oil Violet, Phthalocyanine Blue, Benzidine Yellow, Methyl Orange, Brilliant Carmine, Fast Red, Methyl Violet and so forth.

As the resin (resin $A_1$) which is one component constituting the resin A (used in the toner of the present invention) and having an acetone tolerance value of 100–5000, there can be enumerated natural resin-modified maleic resin, natural resin-modified phenol resin, natural resin-modified pentaerythritol resin, natural resin-modified polyester resin, ester gum, hardened rosin, hydrogenated rosin, styrene-butadiene resin, vinyltoluene-butadiene resin, etc. Those resins which are commercially available can be enumerated as follows.

Examples of the natural resin-modified maleic resins:
- MRG, MGR-411, MGR-S, MRG-H, MRP, MRA-L, MRM-42, MRM-53 (manufactured by TOKUSHIMA SEIYU K.K.)
- Beckacite 1110, Beckacite 1111, Beckacite F 231, Beckacite J-811, Beckacite 1120, Beckacite P-720, Beckacite J-896, (manufactured by DAINIPPON INK AND CHEMICALS INC.)

Examples of the natural resin-modified phenol resins:
- PRG, PRP, SPR-N, SPR-A, SPR-H (manufactured to TOKUSHIMA SEIYU K.K.)
- Beckacite 1100, Beckacite 1123, Beckacite 1126, Beckacite F-171 (manufactured by DAINIPPON INK AND CHEMICALS INC.)

Examples of the natural resin-modified pentaerythritol resins:
- Pentacite P-406, Pentacite P-423 (manufactured by DAINIPPON INK AND CHEMICALS INC.)

Examples of the natural resin-modified polyester resins:
- RM-1000, RM-1300, RM-4090, RM-4100 (manufactured by TOKUSHIMA SEIYU K.K.)

Examples of the ester gum:
- EG-8000, EG-9000, HG-H, PE, PE-H (manufactured by TOKUSHIMA SEIYU K.K.)

Examples of the hardened rosin:
- TLR-21, TLR-57 (manufactured by TOKUSHIMA SEIYU K.K.)

The monomer $A_2$, i.e., one component constituting the resin A, which is to be polymerized with the resin $A_1$ having an acetone tolerance value 100–5000 and also capable of dissolving the resin $A_1$ is substantially homogeneous to the monomer having the general formula (1) in the component (B). Therefore, as the monomer $A_2$ referred to herein there can be enumerated, for instance, vinyl monomers such as stearyl ester, lauryl ester, 2-ethyl hexyl ester or hexyl ester respectively of acrylic acid or methacrylic acid; t-butyl methacrylate; cetyl methacrylate; octyl methacrylate; vinyl stearate, etc.

This monomer $A_2$ may be used in admixture with one kind or more of glycidyl methacrylate, glycidyl acrylate, propylene glycol monoacrylate, propylene glycol methacrylate, hydroxy ethyl methacrylate, acrylonitrile, methacrylonitrile, etc. (which is called monomer C hereinafter). The monomer C is polymerized in the manner of being added to the monomer $A_2$ before the polymerization of the monomer $A_2$ or to the polymerization system after the polymerization of the monomer $A_2$.

The monomer C is capable of dissolving the resin (resin $A_1$) which is substantially insoluble in the nonaqueous solvent, but the polymerized monomer C alone is not capable of solvation with the nonaqueous solvent. The ratio of monomer $A_2$ to monomer C is preferred to be about 70-99:30-1 (by weight).

In the present invention, furthermore, the mixture or polymer obtained from monomer $A_2$ and monomer C may be admixed with one kind or more of acrylic acid, methacrylic acid or its low alkyl esters (1–4 carbon atoms), styrene, methyl styrene, vinyl toluene, vinyl acetate, etc. (which is called monomer D hereinafter). In other words, this monomer D is polymerized by being added to the mixture of monomer $A_2$ and monomer C before the polymerization thereof or to the polymerization system after the polymerization of monomer $A_2$ and monomer C.

The monomer D, like the monomer C, is capable of dissolving the resin $A_1$, but the polymerized monomer D alone is not capable of solvation with the nonaqueous solvent. When the monomer D is used concurrently, the ratio between monomer $A_2$, monomer C and monomer D is preferred to be about 60-90:20-1:20-1 (by weight).

The mixing ratio of resin $A_1$ to monomer $A_2$ (inclusive of the case of monomer $A_2$ and monomer C and the case of monomer $A_2$, monomer C and monomer D) suitably is about 5-50:95-50 (by weight).

In the preparation of resin A (a polymer obained from resin $A_1$ and monomer $A_2$) it is profitable that the polymerization reaction should be made on the monomer $A_2$ in which resin $A_1$ has been dissolved. If this process is employed, the other conditions may be changed variously. For instance, (1) the polymerization reaction of monomer $A_2$ may be made while pouring dropwise the monomer $A_2$ solution containing, dissolved therein, resin $A_1$ into the nonaqueous solvent, and (2) the polymerization reaction is effected with or without the addition of the nonaqueous solvent to the monomer $A_2$ solution in a quantity insufficient to allow the resin $A_1$ to separate therein and the resulting polymer may then be dispersed in the nonaqueous solvent.

As described above, it is preferable that resin A takes the form of a resinous dispersion. This is because it is suitable for subsequent addition of a coloring agent (pigment or dye). To this resinous dispersion may be added waxes or polyolefins whose softening point is in the range of about 60°–130° C., whereby the dispersion stability is further improved. Meantime, the addition of waxes or polyolefins may be made in the monomer solution before polymerization, in the course of polymerization or in the dispersion obtained after the polymerization.

Commercially available waxes or polyolefins are enumerated as follows.

| Maker | Trade name | Softening point (°C.) |
|---|---|---|
| Examples of polyethylenes | | |
| Union Carbide (U.S.A.) | DYNI | 102 |
| | DYNF | 102 |
| | DYNH | 102 |
| | DYNJ | 102 |
| | DYNK | 102 |
| Monsanto Chemicals Co. (U.S.A.) | ORLIZON 805 | 116 |
| | ORLIZON 705 | 116 |
| | ORLIZON 50 | 126 |
| Philipps (U.S.A.) | MARLEX 1005 | 92 |
| Du Pont (U.S.A.) | ALATHON -3 | 103 |
| | ALATHON 10 | 96 |
| | ALATHON 12 | 84 |
| | ALATHON 14 | 80 |
| | ALATHON 16 | 95 |
| | ALATHON 20 | 86 |
| Du Pont (U.S.A.) | ALATHON 22 | 84 |
| | ALATHON 25 | 96 |
| Allied Chemical (U.S.A.) | AC-Polyethylene 1702 | 98 |
| | AC-Polyethylene 686A | 102 |
| | AC-Polyethylene 615 | 105 |
| SANYO KASEI | SANWAX 131-P | 108 |
| | SANWAX 151-P | 107 |
| | SANWAX 161-P | 111 |
| | SANWAX 165-P | 107 |
| | SANWAX 171-P | 105 |
| | SANWAX E-200 | 95 |
| Examples of waxes (paraffin wax) | | |
| JUNSEI KAGAKU | PARAFFIN WAX | 60–98 |
| KOBAYASHI KAKO | SARASHIMITSURO | 65 |
| | SETANOL | 80 |
| NAGAI KAKO | SARASHIMITSURO | 65 |
| SEITETSU KAGAKU | FLOCENE | 110 |

The polymerization conditions may be selected widely, but when heating polymerization is employed, a conventional polymerization initiator, for instance, such as benzoyl peroxide, azobisisobutyronitrile or the like is allowed to present in a monomer solution (a monomer $A_2$ solution dissolved resin $A_1$ therein) or a nonaqueous solvent and the same is heated to a temperature of about 70°–110° C., preferably 80°–100° C.

The raw materials for resin A, that is, resin $A_1$ (which is substantially insoluble in the nonaqueous solvent) and monomer $A_2$, may be used individually or in the admixture of more than two kinds respectively.

Thus there can be obtained a dispersion containing a polymer obtained from the resin $A_1$ which is substantially insoluble in the nonaqueous solvent and the monomer $A_2$ which is capable of solvation with the nonaqueous solvent. And the resin $A_1$ portion of the resin A contained in this dispersion is considered to function as a dispersion stabilizer. On the other hand the polymer portion of the monomer $A_2$ is considered to function as a dispersion stabilizer, polarity controlling agent and fixing agent, depending on the kinds and quantities of the raw material used and the polymerization conditions (temperature, stirring, cooling, etc.).

The function and effect of this resin A in the liquid developer may be varied by the concurrent use of the aforesaid waxes or polyolefins, or the component (B) (nonaqueous type thermoplastic resin) referred to hereinafter. When waxes or polyolefins are concurrently used, the polyolefins, etc. dissolved on heating are quenched and consequently separate as fine particles in the polymerization system, and when separating, said fine particles are dispersed in the polymer, whereby not only the dispersion stability of the toner and the re-dispersibility of the dispersion are more improved but also the control of the viscosity of the dispersed toner and the particle diameter thereof is made possible with the result being that a toner can be obtained which is stable enough to form images having high contrast.

Hereinafter will be enumerated some preparation examples of the resin A (which is obtained as a resinous dispersion in the Preparation Examples). It is to be noted that these preparing methods are simplified, but notwithstanding this, can produce uniform and stable dispersions.

Preparation Example 1

300 g of Isopar H was put in a 1.6 l three-way receptacle equipped with a stirrer, a thermometer and a reflux condenser and the same was heated to 90° C. On the other hand, 80 g of Beckacite F-171 was dissolved in 200 g of 2-ethylhexyl methacrylate and further 2 g of azobisisobutylonitrile was added thereto. The resulting mixture was dropped in said receptacle for 4 hours for the polymerization reaction, and then was subjected to an additional 1 hour's stirring, whereby there was prepared a resinous dispersion whose solid content was 48.3%.

Preparation Example 2

300 g of isooctane was put in the receptacle employed in the preceding Preparation Example 1 and the same was heated to 90° C. On the other hand, 50 g of Beckacite J-8111 was dissolved in 150 g of stearyl methacrylate and 55 g of glycidyl methacrylate, and further 2 g of lauryl dimethylamine, 0.2 g of hydroquinone and 2 g of benzoyl peroxide were admixed therewith. Next, this mixture was dropped in the receptacle for 2.5 hours for the polymerization reaction, and then was heated at 90° C. for about 11 hours to form a resinous dispersion whose solid content was 46.8%.

Preparation Example 3

400 g of Isopar L was put in the receptacle employed in Preparation Example 1 and the same was heated to 90° C. On the other hand, 80 g of Pentacite P-406 was dissolved in a mixed monomer of 18 g of glycidyl methacrylate with 100 g of lauryl methacrylate, and further 2 g of benzoyl peroxide and 2.5 g of lauryl dimethylamine were admixed therewith. Next, this mixture was dropped in the receptacle for 4 hours for the polymerization reaction, whereby these was prepared a resinous dispersion whose solid content was 40%.

Preparation Example 4

The same procedure as Preparation Example 1 was repeated except that 25 g of ORLIZON 705 was dissolved in 300 g of Isopar H and the receptacle (90° C.) was quenched with cooling water at the time of completion of the polymerization reaction, whereby these was prepared a polyethylene-containing resinous dispersion whose solid content was 47.1%.

Preparation Example 5

The same procedure as Preparation Example 3 was repeated except that paraffin wax having a softening point of 80° C. was added to the polymerization system at the time of completion of the polymerization reaction, the same was heated to 90° C. and dissolved, and then after thorough stirring, the receptacle was quenched with city water, whereby there was prepared a paraffin wax-containing resinous dispersion whose solid content was 35%.

Preparation Example 6

300 g of isooctane was put in the receptacle employed in Preparation Example 1 and the same was heated to 90° C. On the other hand, 100 g of Beckacite J 896 was dissolved in a mixed monomer of 200 g of 2-ethylhexyl methacrylate with 10 g of glycidyl methacrylate, and further 2 g of benzoyl peroxide was added thereto. This mixture was dropped in the said receptacle for 3 hours for the polymerization reaction and was maintained at the aforesaid temperature for an additional 3 hours in order to complete the reaction. Thereafter, the mixture was added with 1 g of lauryl dimethylamine, 3 g of methacrylic acid and 0.1 g of hydroquinone and was subjected to reaction at 90° C. for 18 hours. Next, after addition of 500 g of isooctane to this reaction system, a mixture of 50 g of methyl methacrylate and 3 g of benzoyl peroxide was dropped therein for 3 hours and successively was subjected to 5 hours' reaction, thereby preparing a resinous dispersion.

Preparation Example 7

The same procedure as Preparation Example 6 was repeated except that 30 g of SANWAX 131-P was further added to 500 g of isooctane and after completion of the reaction, the receptacle (90° C.) was quenched with city water, whereby there was prepared a polyethylene-containing resinous dispersion.

Preparation Example 8

300 g of Isopar G was put in the receptacle employed in Preparation Example 1 and the same was heated to 90° C. On the other hand, 50 g of Pentacite P-423 was dissolved in a mixed monomer of 200 g of stearyl methacrylate with 5 g of glycidyl methacrylate, and further 0.1 g of hydroquinone and 1 g of lauryl dimethylamine were mixed therewith. This mixture was dropped in the said receptable for 4 hours, and after additional 15 hours' reaction at 90° C., 500 g of Isopar G was added thereto and further a mixture of 50 g of methyl methacrylate and 4 g of azobisisobutylonitrile was dropped thereinto at 90° C. for 3 hours thereby to complete the reaction, resulting in a resinous dispersion whose solid content was 28.4%.

Preparation Example 9

The same procedure as Preparation Example 8 was repeated except that 30 g of SANWAX 165-P was added to 300 g of Isopar G, whereby there was prepared a polyethylene-containing resinous dispersion.

Preparation Example 10

The same procedure as Preparation Example 8 was repeated except that 50 g of methyl methacrylate were not added for reaction, whereby there was prepared a resinous dispersion.

Preparation Example 11

70 g of lauryl methacrylate and 10 g of glycidyl methacrylate were put in the receptacle employed in Preparation Example 1, and 20 g of Beckacite F-231 was dissolved therein. The same was heated to 90° C. and added with 1.5 g of benzoyl peroxide, and was subjected to 8 hours' polymerization reaction. Thereafter, 100 g of Isopar H was added thereto thereby to prepare a resinous dispersion whose solid content was 50%. 1.4 g of pyridine was added to the resulting dispersion, and the same was heated at 90° C. for 20 hours and then cooled.

Preparation Example 12

15 g of methacrylic acid and 1.2 g of pyridine were added to 200 g of the resin of Preparation Example 11, and the same was subjected to polymerization reaction at 90° C. for 15 hours thereby to prepare a resinous dispersion whose solid content was 54%.

Preparation Example 13

200 g of Isopar H was added to 200 g of the resin of Preparation Example 12, and the same was heated to 90° C. 50 g of a low molecular weight polyethylene (SANWAX 171-P) was added therein and dissolved. Thereafter, it was quenched with city water thereby to prepare a resinous dispersion whose solid content was 31%.

Preparation Example 14

The same procedure as Preparation Example 12 was repeated except that 12 g of methacrylic acid was not employed, whereby there was prepared a resinous dispersion whose solid content was 48%.

Next, explanation will be made with reference to the method for preparing the component B (non-aqueous type thermoplastic resin constituting the toner of the present invention, resin B). First, the monomer having the general formula (1) is admixed with glycidyl(metha)acrylate, unsaturated carboxylic acid or its anhydride. This mixture (the weight ratio thereof is 99.9-80:0.1-20) is heated to a temperature of 70°-150° C. for reaction in an aliphatic hydrocarbon solvent and in the presence of azobisisobutyronitrile or the like.

The monomer having the general formula (1), as described above, includes higher alkyl esters (carbon atoms 6-20) such as lauryl ester, 2-ethyl hexyl ester, stearyl ester, vinylstearyl ester, etc. or acrylic acid or methacrylic acid, and as the unsaturated carboxylic acids capable of copolymerization reaction with said monomer there can be enumerated acrylic acid, methacrylic acid, fumaric acid, crotonic acid, itaconic acid, maleic acid, etc.

To this reaction liquid are added a glycidyl(metha)acrylate and an unsaturated carboxylic acid or its anhydride (in particular, an unsaturated carboxylic acid or its anhydride when the copolymer has a glycidyl(metha)acrylate as a structural unit, and a glycidyl(metha)acrylate when the copolymer has an unsaturated carboxylic acid or its anhydride as a structural unit) in the ratio of 0.1-20 parts by weight to 100 parts by weight of the copolymer, and the same is heated to a temperature of 30°-120° C. in the presence of an esterifying catalyst and reacted.

Owing to this reaction, the copolymer is esterified, and at the esterified portion are formed graft active points (since one graft active point is formed per one polymer chain, gelation can not occur readily). The esterified copolymer is to constitute the trunk portion of a graft copolymer to be obtained at the final step and therefore is obtained in the state of being dissolved in the aforesaid non-aqueous solvent.

Moreover, to this reaction liquid are added the monomer having the general formula (2) or the monomer having the general formula (3) or both of these monomers, in the ratio of 5-100 parts by weight to 100 parts by weight of the esterified copolymer, and the same is heated to a temperature of 70°-150° C. in the presence of a catalyst for polymerization such as benzoyl peroxide, azobisisobutyronitrile or the like and reacted.

This reaction can produce a copolymer in which said monomer has been grafted on the esterified copolymer. In this respect, as the lower alkyl esters of acrylic acid (or methacrylic acid) among the aforesaid monomers are used those having carbon atoms 1-4 such as methyl acrylate, ethyl acrylate, propyl acrylate and butyl acrylate (or methacrylate).

The graft copolymer (resin B) can be obtained in the above-mentioned manner, but according to the present invention it may be produced by adding a polyolefin or wax having a softening point of 60°-130° C. at either of the aforesaid steps, heating the non-aqueous solvent until it is dissolved completely and cooling it at the final step. Cooling of the reaction liquid allows the wax or polyolefin present dissolved therein to separate in the form of fine particles.

Hereinafter will be enumerated some preparation examples of the resin B (a resinous dispersion). It is to be noted that these preparing methods are simplified, but notwithstanding this, can produce uniform and stable dispersions.

Preparation Example 15

300 g of Isopar H (manufactured by ESSO Standard Oil Co.) was put in a receptacle equipped with a stirrer, a thermometer and a reflux condenser and the same was heated to a temperature of about 135° C. A mixed solution of 160 g of lauryl methacrylate, 40 g of glycidyl methacrylate and 2 g of benzoyl peroxide was added dropwise to the receptacle for 2 hours, and the resulting mixture was then heated for 1 hour and stirred. Thereafter, it was further added with 1 g of paratoluene sulfonic acid, 5 g of acrylic acid and 1 g of hydroquinone and subjected to reaction at 90° C. for 15 hours.

To this reaction product were added 300 g of Isopar H, and a mixed solution of 55 g of isobutylmethacrylate and 2 g of azobisisabutyronitrile was added dropwise thereto at 90° C. for 1 hour, and stirred for an additional 1 hour thereby to obtain a polymerization reaction product. This product was stable, the solid content being 28%.

Preparation Example 16

300 g of Isopar G (manufactured by ESSO Standard Oil Co.) was put in a receptacle equipped with a stirrer, a thermometer and a reflux condenser, and the same was heated to a temperature of about 120° C. A mixture of 150 g of stearyl methacrylate, 63 g of acrylic acid and 3 g of azobisisisobulytonitrile was added dropwise thereto at a fixed speed for 3 hours, and the same was stirred for 1 hour for completing the reaction.

To this were further added 5 g of glycidyl methacrylate, 0.1 g of hydroquinone and 1 g of lauryldimethylamine. This mixture was subjected to reaction at 90° C. for 15 hours. The copolymer obtained from said reaction was esterified. The degree of esterification was measured as being 48% from the lowering of acid value.

Next, the resulting esterification reaction liquid was added with 500 g of Isopar G. Then, 50 g of methyl methacrylate and 3 g of azabisisobutyronitrile were added thereto dropwise at a fixed speed at 90° C. for 3 hours. For the purpose of terminating the reaction, moreover, the liquid was maintained at 90° C. for about 5 hours.

Still further, 300 g of Isopar G was added to 300 g of this reaction product. Thereafter, the same was heated to 90° C., was added with 50 g of polyethylene (Qrizon 805 manufactured by Monsanto Chemicals Co.) and was dissolved on heating for 1 hour until it became transparent. The thus obtained product was an emulsion latex having a solid content of 17.4% and a particle diameter of 0.3-0.5μ.

The liquid developer according to the present invention may be prepared in the manner of first obtaining a concentrated toner by dispersing the thus obtained resin A and resin B together with 0.1-10 parts by weight of a coloring agent (pigment or dye) per by weight of said resin and an appropriate quantity of a carrier liquid (identical with the non-aqueous solvent) by means of a disperser such as a three-roll mill, attritor and ball mill, and then diluting the concentrated toner with a fixed quantity of a carrier liquid. In this case, a polarity controlling agent may be added thereto in a very small quantity as occasion demands, but in view of the fact that the resin according to the present invention has a strong polarity and is superior in dispersion stability, there is no special necessity of adding said polarity controlling agent.

Now, investigating the developer using the resin B without adding the resin A, it is observed that the resin B is superior in the adsorbability to the pigment or dye particles but it is likely to be inferior in the polarity controlling ability. Accordingly, this developer is not suitably used for the high speed development system because of the defects attributed to the latter that the image density is low and the printing durability is inferior. However, the developer according to the present invention is observed to be superior in the transferability and the fixability on a transfer paper when used for the transfer of a toner image obtained from development of an electrostatic latent image onto the transfer paper. This seems generally attributable to the facts that the resin A is of a low molecular weight (average molecular weight about 1000-5000) as compared with the resin B and is constructed to act as the polarity controlling agent to the full, while the resin B is of a high molecular weight (about 100,000) and is superior in the adsorption to the pigment or dye particles, in other words, the transferability and fixability.

Therefore, the individual use of resin A or resin B can exhibit a satisfactory ability for the low speed development system but can not produce satisfactory images for the high speed developing machine which is capable of developing more than 20 copies (format A-4) per minute.

In contrast, according to the developer of the present invention which comprises the concurrent use of resins A and B there can be produced copied images where are excellent in image density and fixability as well as superior in durability and storage ability. The suitable mixing ratio of resin A to resin B is 1-4:6-9 (by weight).

The hitherto explained liquid developers employ non-treated coloring agents (pigments or dyes) therein. Due to this, the coloring agents occasionally bring about secondary aggregation to such an extent that a normal device such as a ball mill, attritor, ultrasonic wave dispersor or the like can not readily disperse said aggregated coloring agents into primary particles. In this respect, it was confirmed that the use of flushing-processed pigments as the coloring agents herein can avoid occurrence the of aforesaid unforeseen situation. The "flushing-processed coloring agents" referred to herein mean those prepared by means of the moisture cake of pigment, that is, fine particle-like pigments coated with a resin which is substantially insoluble (scarcely soluble or insoluble) in a carrier liquid constituting the finally obtained liquid developer. And, the resin for use in this flushing process is homogeneous to the resin (resin $A_1$) having an acetone tolerance value of 100–5000.

In actually obtaining a suitably flushing-processed coloring agent, a water-containing aqueous pigment just after preparation or a pigment paste obtained from a water-containing non-aqueous pigment and carbon black are put in a kneading machine called a flusher in the mixing ratio of 0-1:1 and mixed to some extent. To this is added a liquid prepared by dissolving a resin in a solvent and well kneaded. The water present surrounding the pigment is thus replaced by the resinous liquid. Thereafter, the water and solvent are removed therefrom in the kneading machine, resulting in a mass. And, by pulverizing this mass there can be obtained an intended flushing-processed coloring agent. The ratio of resin to coloring agent used herein is preferred to be 1–4 parts by weight of the former per part by weight of the latter. In this connection, it is to be noted that in order to obtain the flushing-processed coloring agent it is not always indispensable to use the pigment paste and carbon black concurrently but they may be applied separately.

The thus flushing-processed coloring agent is more advantageous than the non flushing-processed pigment in that the former, even if secondarily aggregated, may be readily divided into primary particles, resulting in uniformly colored toner particles.

Next, there will be given examples for preparing coloring agents by means of flushing processing treatment.

Preparation Example 17

Water: 500 g
Printex G: 30 g
Alkali Blue paste (50% paste): 20 g

The above composition was well stirred by means of a flusher, and then 600 g of Beckacite P-720 (10% toluene solution) was added to the flusher and further kneaded. Subsequently, the same was heated and placed under reduced pressure for removing the water and solvent therefrom to thereby obtain a lump of coloring agent whose water content was 0.92%. This was pulverized by means of a stone mill to obtain 1–5μ fine particles.

Preparation Example 18

Water: 500 g
Carbon MA-11: 25 g
Phthalocyanine Blue paste (80% paste): 30 g

The above composition were well stirred by means of a flusher and then well stirred with shellac. Thereafter, 700 g of a solution of Beckacite F 231 (rosin-modified maleic acid resin manufactured by DAINIPPON INK AND CHEMICALS INC.) was added into the flusher and kneaded for 4 hours while maintaining it at 150° C. Subsequently, it was heated and placed under reduced pressure for removing the water and solvent therefrom to thereby obtain a lump whose water content was 0.80%. This was pulverized by means of a hammer mill thereby to obtain a coloring agent having a particle diameter of 1–10μ.

Preparation Example 19

Water: 1200 g
Carbon MA-11 (manufactured by Mitsubishi Kasei K.K.): 300 g

The above composition was well stirred by means of a flusher, and then 1000 g of RM-1300 (natural resin-modified resin manufactured by Tokushima Seiyu K.K.) and 1000 g of toluene was added thereto and kneaded at 130° C. for 3 hours. Subsequently, the same was heated and placed under reduced pressure for removing the water and solvent to thereby obtain a lump of coloring agent whose water content was 0.92%. This was pulverized by means of a stone mill to obtain fine powders.

Preparation Example 20

Water: 1200 g
Phthalocyanine Green paste (30% paste): 200 g
Carbon Moqul A: 600 g The above composition was well stirred by means of a flusher. Then, 1200 g of natural resin-modified maleic acid resin MRL (manufactured by Tokushima Seiyu K.K.) was added thereto and kneaded at 150° C. for 30 minutes. Thereafter, 1000 g of xylene was added thereto and subjected an additional 1 hour kneading. Then, the water and xylene were removed therefrom to obtain a coloring agent.

In this regard, it is to be noted that the developer according to the present invention can be suitably used for offset printing, charge transfer, press transfer, magnetic transfer and the like, not to speak of general electrophotography.

DESCRIPTION OF THE PREFERRED EMBODIMENTS

EXAMPLE 1

Resin A obtained in Preparation Example 1 (solid content 48.3%): 2.6 g
Resin B obtained from Preparation Example 16 (solid content 17.4%): 20.0 g
Special Black EB (manufactured by Orient Chemicals Company): 1 g
Carbon Mitsubishi #44 (manufactured by Mitsubishi Carbon K.K.): 5 g
Isopar L: 100 g A mixture of the above components was dispersed for 48 hours by means of a ball mill to obtain a concentrated toner. 8 g of the resulting concentrated toner was dispersed in 2 l of Isopar G, whereby a liquid developer was prepared.

Next, an electrostatic latent image was formed on a commercially available electrophotographic photosensitive paper (zinc oxide-resin dispersed system) in a usual manner. Said image was developed using the said developer, obtaining a copy having an image density of 1.36 and further being superior in fixability as compared with usual ones. For the purpose of investigating the stability of the toner, furthermore, the developer was applied to a 2 weeks' forced deterioration test but it hardly deteriorated.

EXAMPLE 2

Resin A obtained in Preparation Example 2 (solid content 46.8%): 5.6 g
Resin B obtained from Preparation Example 15 (solid content 28%): 35.0 g Carbon Black MA-100 (manufactured by Mitsubishi Carbon K.K.): 10 g
Isopar G: 150 g A mixture of the above components was placed in a ball mill and dispersed for 28 hours to obtain a concentrated toner. 15 g of the concentrated toner was dispersed in 2 l of Isopar H thereby to prepare a liquid developer. An image was developed on a commercially available wet electrophotographic offset master using this developer in a usual manner and after being further subjected to a desensitizing treatment, was applied to printing, whereby there were obtained sharp printed copies. Especially since the ink is readily attachable to the image area of the offset master where the toner's sensitizing property was superior, the resulting printed copy was characterized by an image density of more than 1.45, and the offset master could produce more than 20,000 printed copies because of the toner's superior fixability.

EXAMPLE 3

Resin A obtained in Preparation Example 3 (solid content 40%): 5.0 g
Resin B obtained in Preparation Example 15 (solid content 28%): 30.0 g
Triiron tetroxide: 10 g
Isopar G: 100 g A mixture of the above components was dispersed in a ball mill for 48 hours to thereby obtain a concentrated toner. Moreover, 30 g of the concentrated toner was dispersed in 2 l of Isopar G to prepare a liquid developer for use in magnetic transfer. Next, an electrostatic latent image was formed on a commercially available electrophotographic photosensitive paper, and developed using this developer. A transfer paper was superposed thereon, and magnetism was applied thereto from the side of the transfer paper, whereby about 90% of the toner image was transferred onto the transfer paper. The image density was 1.35.

EXAMPLE 4

Resin A obtained in Preparation Example 8 (solid content 28.4%): 5.5 g
Resin B obtained in Preparation Example 16 (solid content 17.4%): 38.0 g
SHELLZOL 71 (aliphatic hydrocarbon manufactured by SHELL Oil Co., Ltd.): 100 g
Mitsubishi Carbon #44: 5.5 g A mixture of above components was dispersed in a ball mill for 50 hours to form a concentrated toner. And 10 g of this concentrated toner was dispersed in 2 l of SHELLZOL 71 to form a negatively charged liquid developer for use in electrostatic transfer.

Next, charge transfer was effected onto transfer papers at the copying speed of 28 copies/min. by means of NEW RECOPY DT-1700 (a copying machine for use in wet development transfer manufactured by Ricoh Co., Ltd.). The transfer rate was about 83%. The transferred image was characterized by an image density of 1.29, a high fixability and a high contrast.

EXAMPLE 5

Resin A obtained in Preparation Example 13 (solid content 31%): 6.0 g
Resin B obtained in Preparation Example 16 (solid content 17.4%): 45 g
Mitsubishi Carbon #100: 15 g
Isopar H: 1100 g A mixture of the above components was dispersed for 15 hours by means of an attritor to form a concentrated toner. And 10 g of this concentrated toner was dispersed in 2 l of Isopar H to prepare a liquid developer. An image was developed on a commercially available wet electrophotographic offset master, and after having further been subjected to a disensitizing treatment, it was applied to printing, whereby there were obtained more than 20,000 of high contrast printed copies as in Example 2.

EXAMPLE 6

Resin A obtained in Preparation Example 1 (solid content 48.3%): 4.8 g
Polyethylene-containing resin A obtained in Preparation Example 9 (solid content 18.5%): 5.0 g
Resin B obtained in Preparation Example 16: 60.0 g
Mogul A (carbon black manufactured by Cabot Incorp.): 50 g
Isopar H: 1120 g The above components were dispersed for 5 hours by means of an attritor (28 r.p.m.) to form a concentrated toner. And 10 g of this concentrated toner was dispersed in 1.5 l of Isopar H to prepare a positively charged liquid developer.

Next, an electrostatic latent image was formed on an organic semi-conductor-containing photosensitive plate, then was developed by using this developer and was press transferred with the result being that about 86% of the toner was transferred onto the transfer paper. The transferred image was characterized by an image density of 1.38 and was further superior in fixability.

EXAMPLE 7

Resin A obtained in Preparation Example 1 (solid content 48.3%): 3.5 g
Resin B obtained in Preparation Example 15 (solid content 28%): 38.5 g
Coloring agent (flushing pigment obtained in Preparation Example 20): 10 g
Isooctane: 200 g A mixture of the above components was dispersed for 16 hours by means of a ball mill to form a concentrated toner. And 25 g of this concentrated toner was dispersed in 1 l of isooctane to prepare a liquid developer. Copying was effected using this developer by means of NEW RECOPY DT-1700, whereby there were obtained copies characterized by a transfer ratio of 86%, an image density of 1.30 and an excellent fixability.

EXAMPLE 8

Resin A obtained in Preparation Example 3 (solid content 40%): 5.0 g
Resin B obtained in Preparation Example 15 (solid content 28%): 40.0 g
Coloring agent (flushing pigment obtained in Preparation Example 17): 10.0 g
Isooctane: 200 g A mixture of the above components was dispersed for 20 hours by means of an attritor to form a concentrated toner. And 35 g of this concentrated toner was dispersed in 1 l of isooctane to prepare a liquid developer.

Copying was effected using this developer in accordance with the same procedure as Example 1 to obtain the results: transfer ratio 83%, and image density 1.29. On the other hand, copying was effected in the same manner by the use of a developer after 30 days' storage at 50° C., thereby obtaining copies characterized by a transfer ratio of 81.5, image density of 1.27, a superior storageability, a good transferability and a high image density. And, the average toner particle diameter was 0.20–0.30μ, that is, totally unchanged.

EXAMPLE 9

Resin A obtained in Preparation Example 6 (solid content 30.0%): 10 g
Resin B obtained in Preparation Example 16 (solid content 17.4%): 60 g
Coloring agent (flushing pigment obtained in Preparation Example 19): 10 g
Carbon MA-11 (manufactured by Mitsubishi Kasei K.K.): 5 g
Isopar G: 100 g A mixture of the above components was dispersed for 18 hours by means of an attritor to form a concentrated toner. And 50 g of this concentrated toner was dispersed in 2 l of Isopar G to prepare a liquid developer. The average toner particle diameter was 0.32μ, and the transmission was 35%.

This developer was stored at 50° C. for 30 days, and thereafter was measured likewise with reference to the average particle diameter and transmission. As a result, this developer was observed to have an average particle diameter of 0.33μ and a transmission of 35.5%, in other words the toner particle was observed to undergo hardly any change.

EXAMPLE 10

Resin A obtained in Preparation Example 8 (solid content 28.4%): 20 g
Resin B obtained in Preparation Example 16 (solid content 17.4%): 80 g
Coloring agent (flushing pigment obtained in Preparation Example 17): 30 g
Special Black (manufactured by ORIENT KASEI K.K.): 3 g
Isopar G: 150 g A mixture of the above components was dispersed for 10 hours by means of a colloid mill to form a concentrated toner. This concentrated toner was placed in a glass battle and sealed up, and was stored for a forced deterioration test at 50° C. for 30 days to prove, as shown in the following table, that changes were scarcely observed with reference to the viscosity, toner particle diameter, etc.

| | Just after preparation | After storage at 50° C. for 30 days | After storage at 20° C. for 30 days |
|---|---|---|---|
| Viscosity | 58 centi poises | 62 centi poises | 60 centi poises |
| Toner particle diameter | 0.34 μ | 0.36 μ | 0.34 μ |

And 50 g of this concentrated toner was dispersed in 1 l of Isopar G to prepare a liquid developer. Copying was effected using this developer by means of NEW RECOPY DT-1700 to obtain the results: the image density (after storage at 20° C. for 30 days) was 1.32, that (after storage at 50° C. for 30 days) 1.33 and that just after preparation 1.30.

What is claimed is:

1. A liquid developer for use in electrophotography which comprises a carrier liquid comprising a non-aqueous solvent having a high insulating property and a low dielectric constant, said carrier liquid having a coloring agent and a resin dispersed therein, characterized in that said resin contains the following components (A) and (B):

(A) a polymer prepared by subjecting to polymerization conditions a solution of at least one kind of resin having an acetone tolerance value of 100–5000 dissolved in at least one kind of monomer capable of dissolving said resin whereby to polymerize said monomer, and (B) a non-aqueous thermoplastic resin obtained by preparing a copolymer by copolymerizing a monomer having the formula I,

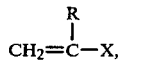

wherein R is —H or —$CH_3$ and X is —$COOC_nH_{2n+1}$ or —$OC_nH_{2n+1}$ ($6 \leqq n \leqq 20$), with a monomer selected from the group consisting of a monomer having a glycidyl group, an unsaturated carboxylic acid and an anhydride thereof, then esterifying said copolymer with said unsaturated carboxylic acid or anhydride thereof when said copolymer has a glycidyl group as a structural unit thereof or with said monomer having the glycidyl group when the copolymer has an unsaturated carboxylic acid or anhydride thereof as a structural unit thereof, and then further graft-polymerizing the unsaturated portion of the resulting esterification product with at least one monomer selected from the group consisting of monomer having the formula II

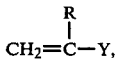

wherein R is —H or —$CH_3$ and Y is —$COOC_{n'}H_{2n'+1}$ ($1 \leqq n' \leqq 4$), —$OCOC_mH_{2m+1}$ ($1 \leqq m \leqq 6$),

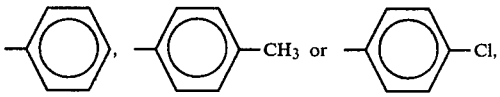

and monomer having the formula III,

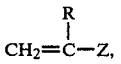

wherein R is —H or —$CH_3$ and Z is —$COOCH_2CH_2N(C_{n''}H_{2n''+1})_2$ ($1 \leqq n'' \leqq 5$), —COOH, —$COOC_2H_4OH$ or

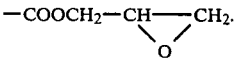

2. A liquid developer according to claim 1 wherein said coloring agent is one obtained by flushing a moist paste comprising carbon black and/or organic pigment with a resin having an acetone tolerance value of 100–5000.

3. A liquid developer according to claim 2 wherein the mixing ratio of said resin to said pigment in said flushing-processed coloring agent is 3–9 parts by weight:1–7 parts by weight.

4. A liquid developer according to claim 2 wherein the flushing-processed coloring agent comprises organic pigment and carbon black mixed in the ratio of 0–1 part by weight:1 part by weight.

5. A liquid developer according to claim 1 wherein the component (A) or the component (B) contains a wax or a polyolefin having a softening point of 60°–130° C.

6. A liquid developer according to claim 1 wherein the ratio of the component (A) to the component (B) is 1–4 parts by weight:6–9 part by weight.

7. A liquid developer according to claim 1 or claim 2 wherein said resin having an acetone tolerance value of 100–5000 is at least one member selected from the group consisting of natural resin-modified maleic acid resin, natural resin-modified phenol resin, natural resin-modified pentaerythritol resin, natural resin-modified polyester resin, ester gum, hardened rosin, hydrogenated rosin, styrenebutadiene resin and vinyltoluene-butadiene resin.

8. A liquid developer for use in electrophotography which consists essentially of: a non-aqueous carrier liquid having a high insulating property and a low dielectric constant, coloring agent particles dispersed in said carrier liquid, and first and second non-aqueous resin dispersions dispersed in said carrier liquid, (A) said first resin dispersion consisting essentially of non-aqueous solvent having a high insulating property and a low dielectric constant, said solvent having dispersed therein a polymer prepared by subjecting to polymerization conditions a solution of (1) at least one kind of resin $A_1$ having an acetone tolerance value of from 100 to 5000 and which is substantially insoluble in said non-aqueous solvent, dissolved in (2) first monomer $A_2$ which is capable of dissolving said resin $A_1$, whereby to polymerize said first monomer $A_2$, the weight ratio of said resin $A_1$:said first monomer $A_2$ being in the range of from about 5–50:50–95, said polymer being solvated by said non-aqueous solvent, (B) said second resin dispersion consisting essentially of said non-aqueous solvent having dispersed therein a graft copolymer prepared by copolymerizing (1) monomer having the formula

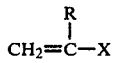

wherein R is H or $CH_3$ and X is $COOC_nH_{2n+1}$ or $OC_nH_{2n+1}$, wherein n is an integer of from 6 to 20 with either (2) glycidyl acrylate or glycidyl methacrylate or (3) unsaturated carboxylic acid or anhydride thereof, wherein the weight ratio of (1):(2) or (3) is from 99.8–80:0.1–20, to obtain a copolymer, then esterifying said copolymer with either (i) unsaturated carboxylic acid or anhydride thereof when said copolymer has been prepared using glycidyl acrylate or glycidyl methacrylate or (ii) glycidyl acrylate or glycidyl methacrylate when said copolymer has been prepared using said unsaturated carboxylic acid or anhydride thereof, wherein the weight ratio of (i) or (ii) to said copolymer is 0.1–20:100, and then graft polymerizing said esterified copolymer with at least one grafting monomer selected from the group consisting of monomer having the formula

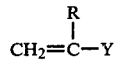

wherein R is H or $CH_3$, and Y is $COOC_{n'}H_{2n'+1}$ wherein n' is an integer of 1 to 4, $OCOC_mH_{2m+1}$ wherein m is an integer of 1 to 6,

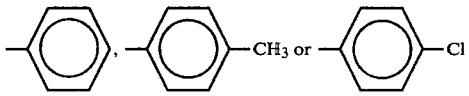

and monomer having the formula

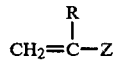

wherein R is H or $CH_3$, and Z is $$COOCH_2CH_2N(C_{n''}H_{2n''+1})_2$$

wherein n'' is an integer of 1 to 5, COOH, $COOC_2H_4OH$ or

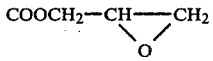

wherein the weight ratio of said grafting monomer to said esterified copolymer is 5–100:100, the weight ratio of (A):(B) being in the range of 1–4:6–9, calculated as the solids.

9. A liquid developer as claimed in claim 8 in which said first monomer $A_2$ is selected from the group consisting of stearyl acrylate, stearyl methacrylate, lauryl acrylate, lauryl methacrylate, 2-ethylhexyl acrylate, 2-ethylhexyl methacrylate, hexylacrylate, hexyl methacrylate, t-butyl methacrylate, cetyl methacrylate, octyl methacrylate and vinyl stearate, and said resin $A_1$ is selected from the group consisting of natural resin-modified maleic resin, natural resin-modified phenol resin, natural resin-modified pentaerythritol resin, natural resin-modified polyester resin, ester gum, hardened rosin, hydrogenated rosin, styrene-butadiene resin and vinyltoluene-butadiene resin.

10. A liquid developer as claimed in claim 9 in which said first resin dispersion also contains a polymer of at least one monomer C selected from the group consisting of glycidyl methacrylate, glycidyl acrylate, propylene glycol monoacrylate, propylene glycol methacrylate, hydroxyethyl methacrylate, acrylonitrile and methacrylonitrile, wherein the weight ratio of monomer $A_2$:monomer C is 70–99:30–1.

11. A liquid developer as claimed in claim 8 in which said first resin dispersion also contains a polymer of at least one monomer D selected from the group consisting of acrylic acid, alkyl ($C_1$ to $C_4$) esters of acrylic acid, methacrylic acid, alkyl ($C_1$ to $C_4$) esters of methacrylic acid, styrene, methyl styrene, vinyl toluene and vinyl acetate.

12. A liquid developer as claimed in claim 10 in which said first resin dispersion also contains a polymer of at least one monomer D selected from the group consisting of acrylic acid, alkyl ($C_1$ to $C_4$) esters of acrylic acid, methacrylic acid, alkyl ($C_1$ to $C_4$) esters of methacrylic acid, styrene, methyl styrene, vinyl toluene and vinyl acetate, wherein the weight ratio of monomer $A_2$:monomer C:monomer D is 60–90:20–1:20–1.

* * * * *